United States Patent [19]

Tada et al.

[11] Patent Number: 4,873,549

[45] Date of Patent: Oct. 10, 1989

[54] DEVICE FOR DETECTING THE LIFE OF AN IMAGE FORMING PROCESS UNIT, OPENING OF A SEAL OF THE UNIT AND ATTACHMENT OF THE UNIT TO AN IMAGE FORMING APPARATUS

[75] Inventors: Tomio Tada; Junichi Hirobe, both of Osaka; Junichi Takamatsu, Hannan; Kazuto Hori, Sakai; Yukihiro Aikawa, Osaka, all of Japan

[73] Assignee: Mita Industrial Co., Ltd., Osaka, Japan

[21] Appl. No.: 161,571

[22] Filed: Feb. 29, 1988

[30] Foreign Application Priority Data

| | | | |
|---|---|---|---|
| Mar. 3, 1987 | [JP] | Japan | 62-49606 |
| Mar. 3, 1987 | [JP] | Japan | 62-49607 |
| Mar. 3, 1987 | [JP] | Japan | 62-49610 |
| Apr. 17, 1987 | [JP] | Japan | 62-95534 |

[51] Int. Cl.[4] ..... G03G 21/00

[52] U.S. Cl. ..... 355/206; 355/209; 355/246; 355/260

[58] Field of Search ..... 355/3 R, 3 DD, 3 DR, 355/3 BE, 140, 203, 204, 205, 206, 209, 246, 260

[56] References Cited

U.S. PATENT DOCUMENTS

| | | | |
|---|---|---|---|
| 4,003,064 | 1/1977 | Mason | 354/317 X |
| 4,538,896 | 9/1985 | Tajima et al. | 355/3 R |
| 4,550,998 | 11/1985 | Nishikawa | 355/3 DD |
| 4,551,000 | 11/1985 | Kanemitsu et al. | 355/3 R |
| 4,582,415 | 4/1986 | Hyodo et al. | 355/3 DD |
| 4,615,608 | 10/1986 | Mizutani | 355/3 DD |
| 4,669,856 | 6/1987 | Yamada | 355/3 DD |
| 4,742,372 | 5/1988 | Takahashi | 355/3 DD X |
| 4,771,313 | 9/1988 | Kuroda et al. | 355/3 R |

FOREIGN PATENT DOCUMENTS

| | | |
|---|---|---|
| 58-152263 | 9/1983 | Japan . |
| 59-61846 | 4/1984 | Japan . |
| 59-61850 | 4/1984 | Japan . |
| 59-61861 | 4/1984 | Japan . |
| 60-87354 | 5/1985 | Japan . |
| 60-114870 | 6/1985 | Japan . |
| 61-77062 | 4/1986 | Japan . |

OTHER PUBLICATIONS

Williams, G. T., "Toner Control Interlocks", IBM Technical Disclosure Bulletin, vol. 17, No. 4, Sep. 1974, p. 1096.

*Primary Examiner*—Fred L. Braun

*Attorney, Agent, or Firm*—Jordan and Hamburg

[57] ABSTRACT

A device for detecting the life of a process unit which is detachably mounted in an image forming apparatus includes a sensor for detecting the density of the toner in the developing device and a signal detector receiving an output from the sensor and operable to determine whether the output exceeds or is less than a predetermined value during a predetermined time period which starts after a developing roller of the process unit starts rotating. A control is connected to the signal detector and is operable to effect different operating conditions depending on whether the output exceeds or is below the predetermined value, one of the operating conditions being an indication that the life of the process unit has expired and another of the operating conditions being an indication that the life of the process unit is unexpired.

21 Claims, 12 Drawing Sheets

DEVICE FOR DETECTING THE LIFE OF AN IMAGE FORMING PROCESS UNIT, OPENING OF A SEAL OF THE UNIT AND ATTACHMENT OF THE UNIT TO AN IMAGE FORMING APPARATUS

BACKGROUND OF THE INVENTION AND RELATED ART STATEMENT

The present invention relates to a process unit constituting a detachable part of an image forming means of an image forming apparatus such as a copying machine and the like, particularly to a device for detecting life of the process unit, and to a device for detecting opening of a seal of the process unit in which developer is contained in a storage section defined by a seal member prior to use and the seal member is opened for use, and further to a device for detecting attachment of the unit to the image forming apparatus.

It is conventionally known that for the purpose of facilitating maintenance and exchange of expendable parts and the like of an image forming apparatus using an electrographic system etc., a part or the whole of the image forming apparatus comprising a photosensitive drum, a developing device, a cleaning device and the like are integrated to form a process unit which is detachably attached to the image forming apparatus (see, for example, Unexamined Japanese patent publication No. 56-128958).

Such a process unit is, as an expendable, replaced by a new one for ensuring the quality of a copy image when the process unit is used up to lose its life. Then, a means for detecting the life of the process unit and informing users of the same is known which is adapted to measure the amount of used transfer paper passing through the process unit or count the number of rotations of a photosensitive drum, and give a visible indication when the obtained value reaches a predetermined value which means a predetermined life level of the process unit (see, for example, Unexamine Japanese patent publication No. 58-152263).

According to the abovementioned life detecting system, however, for example by making a large amount of copies of an original having a high density, toner is consumed before visible indication of the life of the process unit is made on the basis of the counted rotation number of the drum, which makes it difficult to detect the life of the process unit. Besides, poor copied images are produced, and so-called carrier attraction occurs; that is a carrier is attracted to a latent image on the photosensitive surface, transferred onto a transfer paper, and further slipped in a fixing device, thereby resulting in damage to a heat roller thereof, and causing troubles in temperature control by means of a thermister.

Further, in a copying machine etc. in which the density of the toner contained in a developing device is detected and the amount of toner supply is controlled to obtain a given toner density, if the toner density is below a given value, a process unit may be judged to lose its life due to toner consumption. In this case, however, without choosing the best timing for the judgement, the toner density cannot be accurately detected by means of a sensor, and sometimes it becomes difficult to accurately detect the life and the detection takes too much time, thereby lowering the efficiency.

Furthermore, in a conventional process unit in which at least a developing device is included in a casing, for the purpose of preventing the dispersion of developer held in the developing device as well as preventing the photosensitive surface from being roughed by the dispersed developer, the developer is contained in a space of the developing device defined by a seal member when the process unit is in a packaged state prior to use, and by opening or peeling off the seal member for use i.e., at the time of setting the process unit, the developer is supplied into a developer chamber where a developing roller of the developing device is located so that images can be formed (see, for example, Unexamined Japanese patent publication No. 59-61861).

In conventional arts, however, since no means is provided for detecting opening of the seal member, a user sometimes forgets to peel off the seal member and the image forming operation is carried out with the seal member being still unopened. In such a case, naturally no image is formed and the transfer paper is wasted as a miscopy or blank copy.

Further, since a conventional image forming apparatus is not provided with any means for detecting attachment of the process unit to the apparatus as well as detecting connection of a predetermined control system, the apparatus with the process unit being unattached still appears to be in an image forming or copying state.

Therefore, if the copying operation is carried out with a process unit being unattached, a jam of paper often occurs, and even if the paper can be passed through, naturally no image is formed, so that transfer paper is wasted as a miscopy or blank copy. For eliminating such problems, a switch may be provided for detecting attachment of the process unit, which makes, however, the apparatus expensive.

SUMMARY OF THE INVENTION

An object of the present invention is to provide a device for surely detecting the life of a process unit so that a high quality image is always formed without need of using any particular device or time.

Another object of the present invention is to provide a device for detecting opening of a seal member of a process unit so as to prevent miscopying.

A further object of the present invention is to provide a device for easily and inexpensively detecting attachment of a process unit to an image forming apparatus.

These objects can be realized according to the present invention by providing a device for detecting the life of a process unit which is detachably attached to an image forming apparatus and in which at least a developing device is included in a casing, comprising a sensor for detecting the density of the toner contained in the developing device, a detecting means for detecting whether the output of the sensor is above a predetermined value after a developing roller of the developing device starts rotating and before a predetermined time lapses, and a control means for judging and issuing a signal indicating that the process unit has lost its life when the output of the sensor is above the predetermined value at the time that the abovementioned predetermined time has lapsed.

According to the present invention, the life of the process unit is detected after the developer is adequately stirred and the output of the sensor is stabilized, so that stabilized and reliable life detection can be achieved and a high quality image is always formed. And further, so-called carrier attraction can be prevented, which often occurs in a life detecting system including means for counting the number of rotations of a photosensitive drum.

For realizing the abovementioned objects, according to the present invention, a process unit including a developer storage section defined by a seal member in a part of a developing device for containing developer, whereby when using an image forming apparatus, the developer is supplied into a developer chamber in which a developing roller is located by opening the seal member, is provided with a sensor located adjacent to the developing device for detecting presence of the developer or the density of toner contained in the developer chamber, and control means for judging and issuing a signal indicating that the seal member is unopened when the output of the sensor is different from a predetermined value of the usual use state.

According to the present invention, if a user forgets to open the seal when setting the process unity, the developer is not supplied into the developer chamber and the controller can judge and give the user information that the seal member is unopened, so that miscopying can be prevented.

For realizing the abovementioned objects, a device according to the present invention comprises a sensor for detecting the presence of developer or the denity of toner and having an output terminal which issues signals, and a control means positioned on the side of an apparatus and having an input terminal in which the sensor signals are sent, the output terminal of the sensor and the input terminal of the control means being connected to each other when attaching the process unit to the apparatus, and the control means judging and issuing a signal indicating that the process unit is unattached when the voltage of the input terminal thereof is different from the voltage of the usual use state.

According to the present invention, depending upon the fact that the voltage of the input terminal of the control means at the time that the process unit is attached to an apparatus is different from that at the time that the process unit is unattached, the attachment of the process unit can be inexpensively detected without use of any separate detecting switch or the like. Also, if unattached, miscopying can be prevented by calling the user's attention.

DETAILED DESCRIPTION OF PREFERRED EMBODIMENT'S OF THE INVENTION

Embodiments of the present invention will now be described below with reference to the appended drawings.

Figure 1:
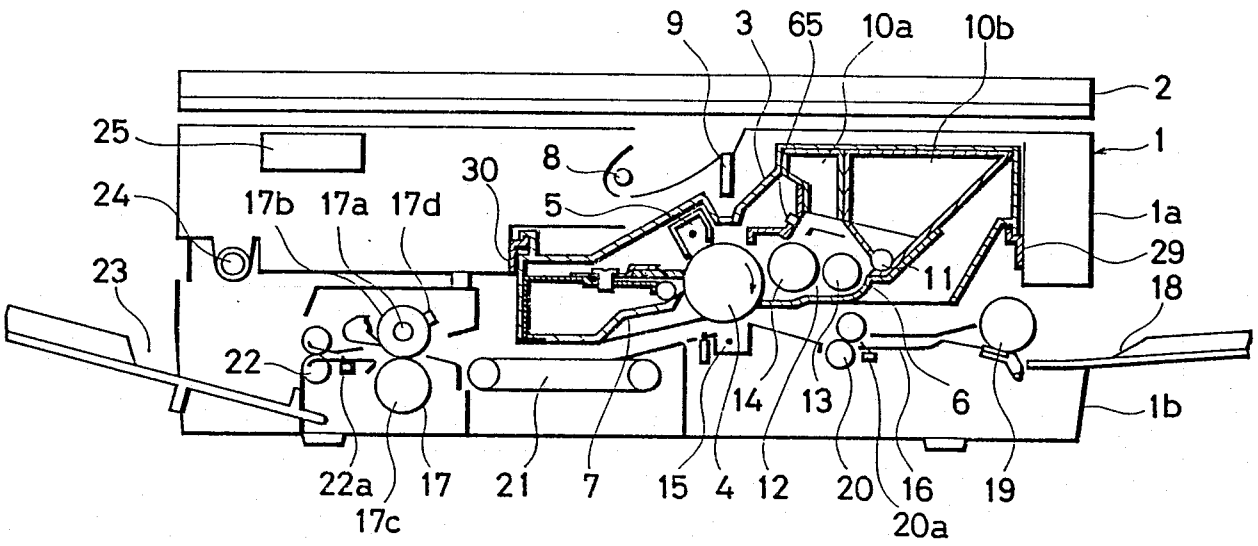
FIG. 1 is a schematic sectional view of an image forming apparatus to which a device according to the present invention is attached.

FIG. 1 illustrates the whole construction of an image forming apparatus to which a device of the present invention is attached.

In this figure, over the upper face of a body of an image forming apparatus 1, these is provided a reciprocatable original holder 2. Inside the apparatus 1, an image forming process unit 3 is detachably attached to the apparatus 1. The process unit 3 is, as an expendable, replaced by a new one when it is used up to lose its life, the process unit 3 comprises a rotatable photosensitive drum 4 and a main charger 5, a developing device 6 and a cleaning device 7 arranged around the drum 4 sequentially in the direction of the rotation of the drum 4, all of which are accommodated in a casing.

Further, the image forming apparatus 1 has an exposure lamp 8 for exposing an original to light and a convergent light transmission member 9 by which an exposed and scanned original image is focused on the photosensitive drum 4 to produce a latent electrostatic image.

The developing device 6, though described later in detail, has developer storage sections 10*a*, 10*b* in a part of which an initial developer and supplementary toner is sealedly contained. Further, within a developer chamber 12 into which the developer is supplied from the strage section 10*a* or 10*b* by means of a supply roller 11 are provided a stirring roller 13 for stirring the developer and a developing roller 14 opposed to the photosensitive drum 4 so as to develop a latent electrostatic image on the photosensitive drum into a toner image, and the like.

The image forming apparatus 1 further has a transfer device 15 for transferring a toner image onto transfer paper, a means 16 for conveying transfer paper to a transferring section of the transfer device 15 and a fixing device 17 for fixing a transferred image on the transfer paper. The transfer device 15 is located on the downstream side of the developing device 6 in the rotational direction of the photosensitive drum. The fixing device 17 is located on the downstream side of the conveying direction of the transfer paper. The fixing device 17 comprises a heat roller 17*b* provided with a heater 17*a*, a pressure roller 17*c* and a thermister 17*d* for controlling the temperature.

Figure 2:
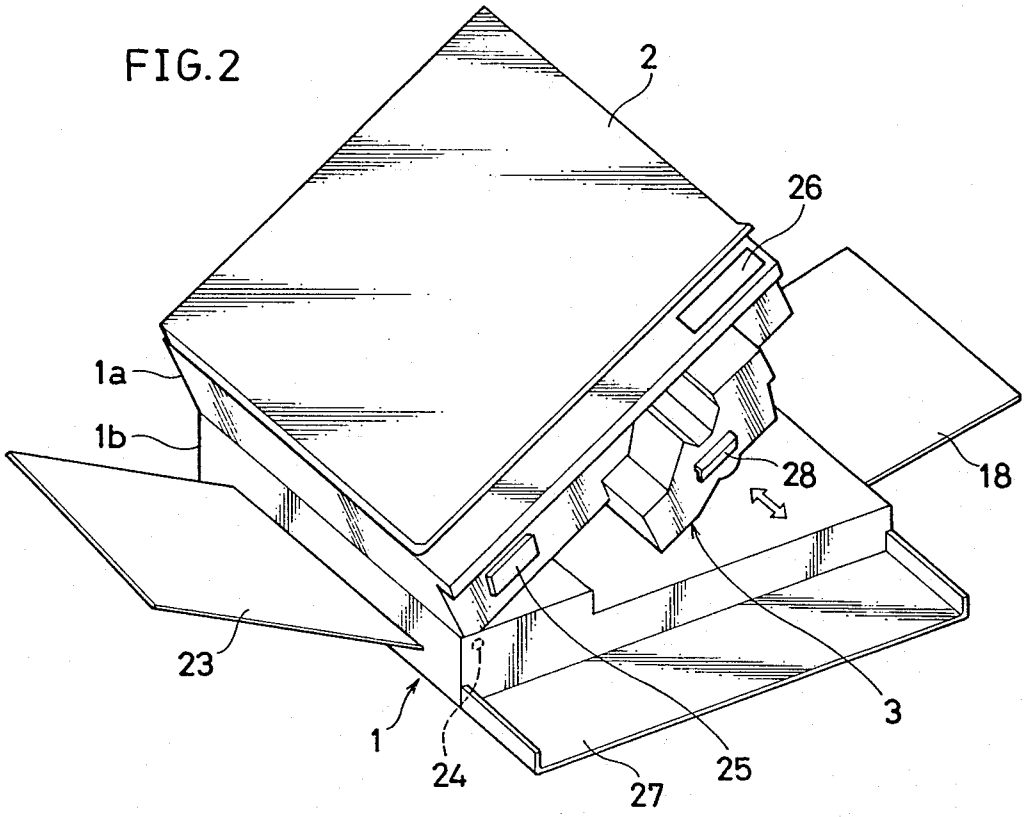
FIG. 2 is a perspective view of the apparatus in which an upper casing of the apparatus is opened.

In FIG. 1 are further illustrated a paper feed tray 18 located on the upstream side of the conveying mean 16, a paper feed roller 19, a pair of registration rollers 20, a conveying belt 21, a paper discharge roller 22, a paper discharge tray 23 and a pivot 24 for pivotally supporting an upper casing 1*a* and a lower casing 1*b* of the image forming apparatus 1 at one end thereof so that the upper casing 1*a* can be opened about the pivot 24 for maintenance and examination of the apparatus 1, further, there are illustrated control means (CPU) comprising a microcomputer and others for controlling the image forming operations of the apparatus 1, an operation and indication portion 26, a front lid 27 (FIG. 2 illustrates an opened position), a pull 28 provided on the front face of the process unit 3 for inserting the process unit 3 into the apparatus 1 and detaching it therefrom in the directions of the arrow illustrated in FIG. 2 and rails 29, 30 provided in the apparatus 1 for guiding the process unit 3 so as to be inserted into and detached from the apparatus 1.

Figure 3:
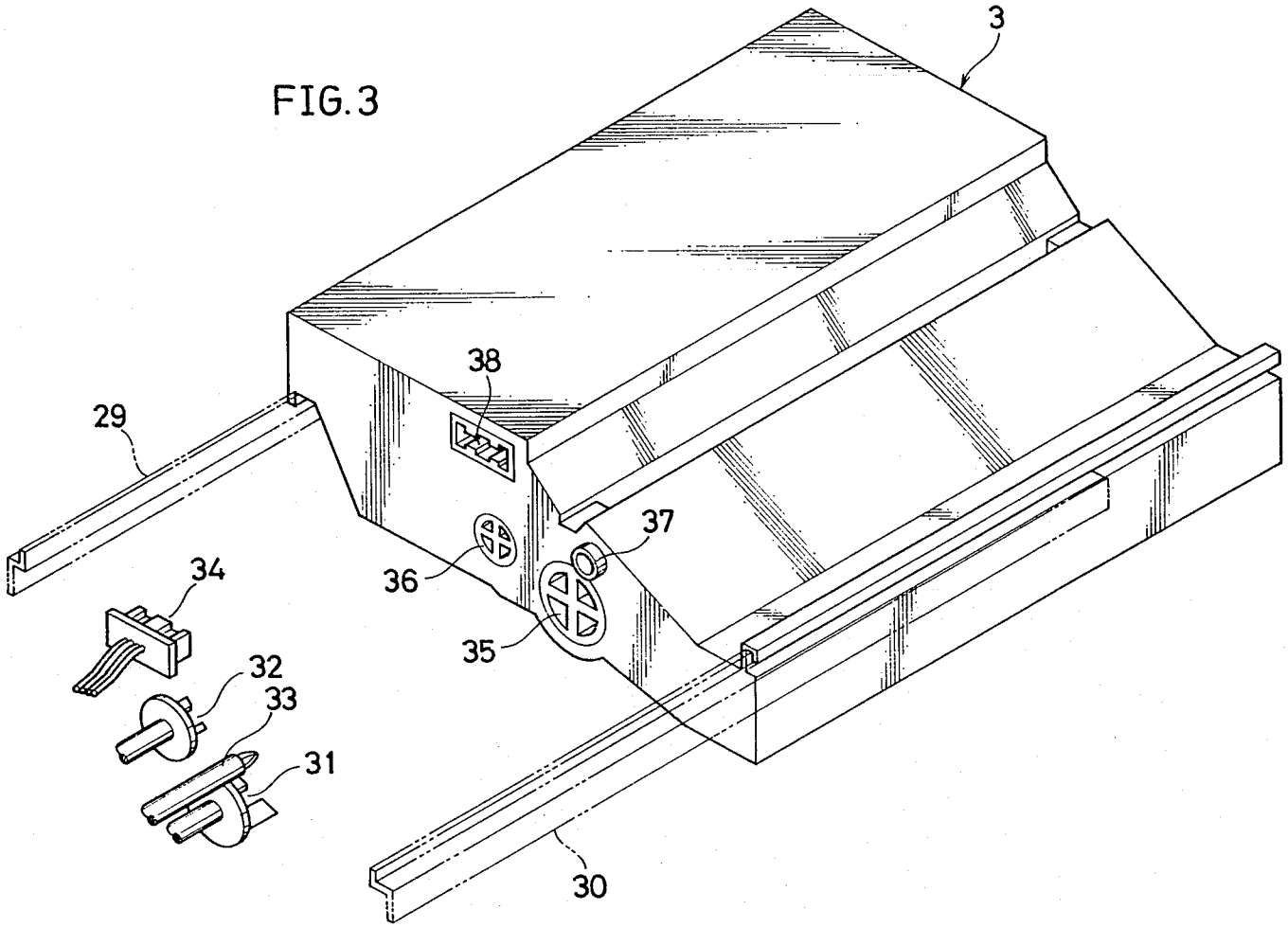
FIG. 3 is a rearward perspective views of a process unit to be attached to the apparatus.

FIG. 3 illustrates the rear part of the process unit 3. In the rear side plate (not shown) of the apparatus 1 are provided a coupling 31 for a drive shaft of the drum 4, a coupling 32 for a drive shaft of the developing roller 14, a terminal 33 for supplying power to the main charger 5, and a connector 34 for receiving signals from a sensor for detecting the density of toner contained in the developing device 6. And corresponding to the above elements, in the rear side of the process unit 3, are provided a coupling 35 for the shaft of the drum 4, a coupling 36 for the shaft of the developing roller 14, a connector 37 for the main charger 5 and a connector 38 for the sensor, accordingly, all the abovementioned elements are connected with one another by attaching the process unit 3 to the apparatus 1.

Figure 4:
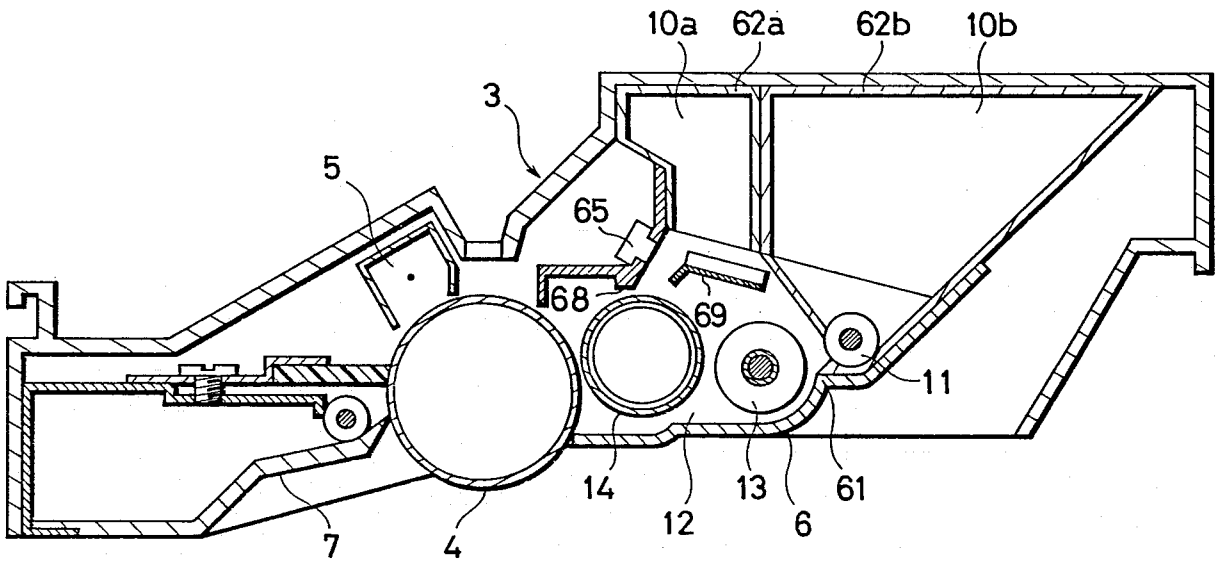
FIG. 4 is a sectional view of the process unit.

FIG. 4 illustrates the process unit 3. In an upper portion of a casing 61 of the developing device 6 in the process unit 3, are provided containers 62*a*, 62*b* constituting the developer storage sections 10*a*, 10*b*. Initial developer in the developer storage section 10*a* is supplied into the developer chamber 12 of the casing 61. Supplementary toner in the developer storage section 10*b* is supplied into the developer chamber 12 by means of the supply roller 11. Further, adjacent to the developing device 6 is provided a toner density sensor 65 comprising a magnetic permeability sensor or the like for detecting the toner density of the developer contained in the developing device 6. Accordingly, the control means 25 controls, according to the output of the sensor 65, the rotation of the supply roller 11 so as to obtain the predetermined density of the toner contained in the developing device 6. Further in FIG. 4, numeral 68 indicates a header for regulating the height of the developer on the developing roller 14. Numeral 69 indicates a guide plate for helping circulating of the developer.

Figure 5:
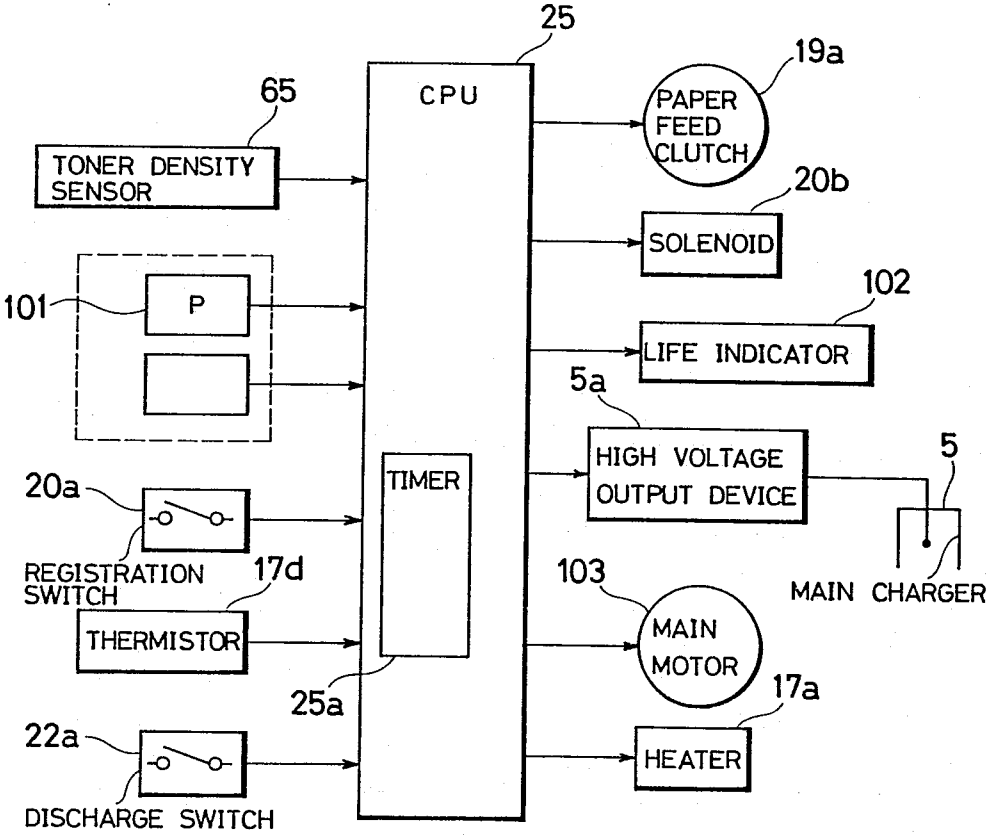
FIG. 5 is a block diagram showing the construction of the device for detecting the life of the process unit.

FIG. 5 illustrates a construction of the main part of a device for detecting the life of the process unit 3. The control means 25 includes a CPU for performing a given calculation and control and a timer 25*a*. The control means 25 receives signals from the toner density sensor 65, a print key 101, a registration switch 20*a* for detecting that the leading edge of transfer paper is fed to the pair of registration rollers 20 by the paper feed roller 19 (referred to as first paper feeding hereinafter), and the thermister 17*d* respectively. On the other hand, the control means 25 sends signals in a predetermined timing mentioned below to a paper feed clutch 19*a* for switching on the paper feed roller 19, a solenoid 20*b* for driving the pair of registration rollers 20, a life indicator 102, a high voltage output device 5*a* for energizing the main charger 5, a main motor 103 functioning as a driving source of the drum 4 and the developing roller 14, and the heater 17*a*.

Figure 6A:
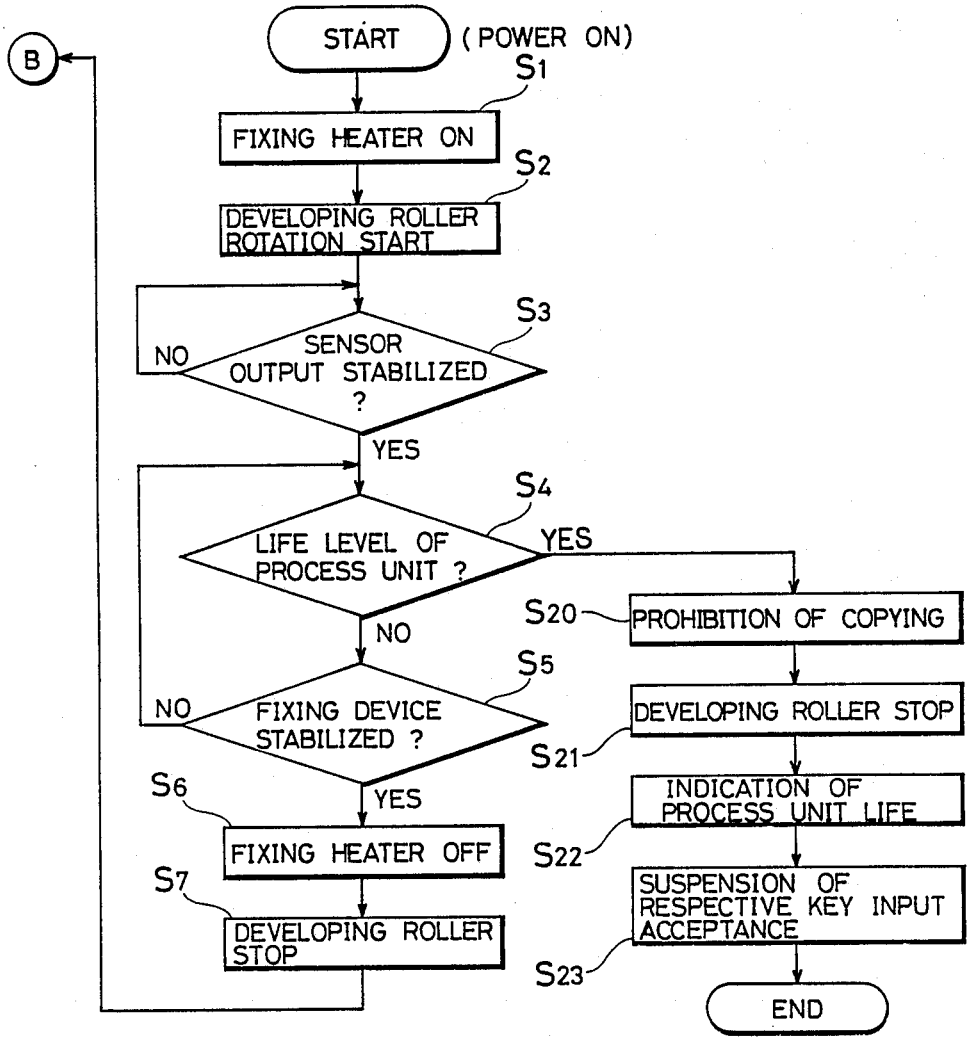
FIG. 6A, 6B, and 7 are flow charts showing the operation for detecting life the of the process unit.
Figure 6B:
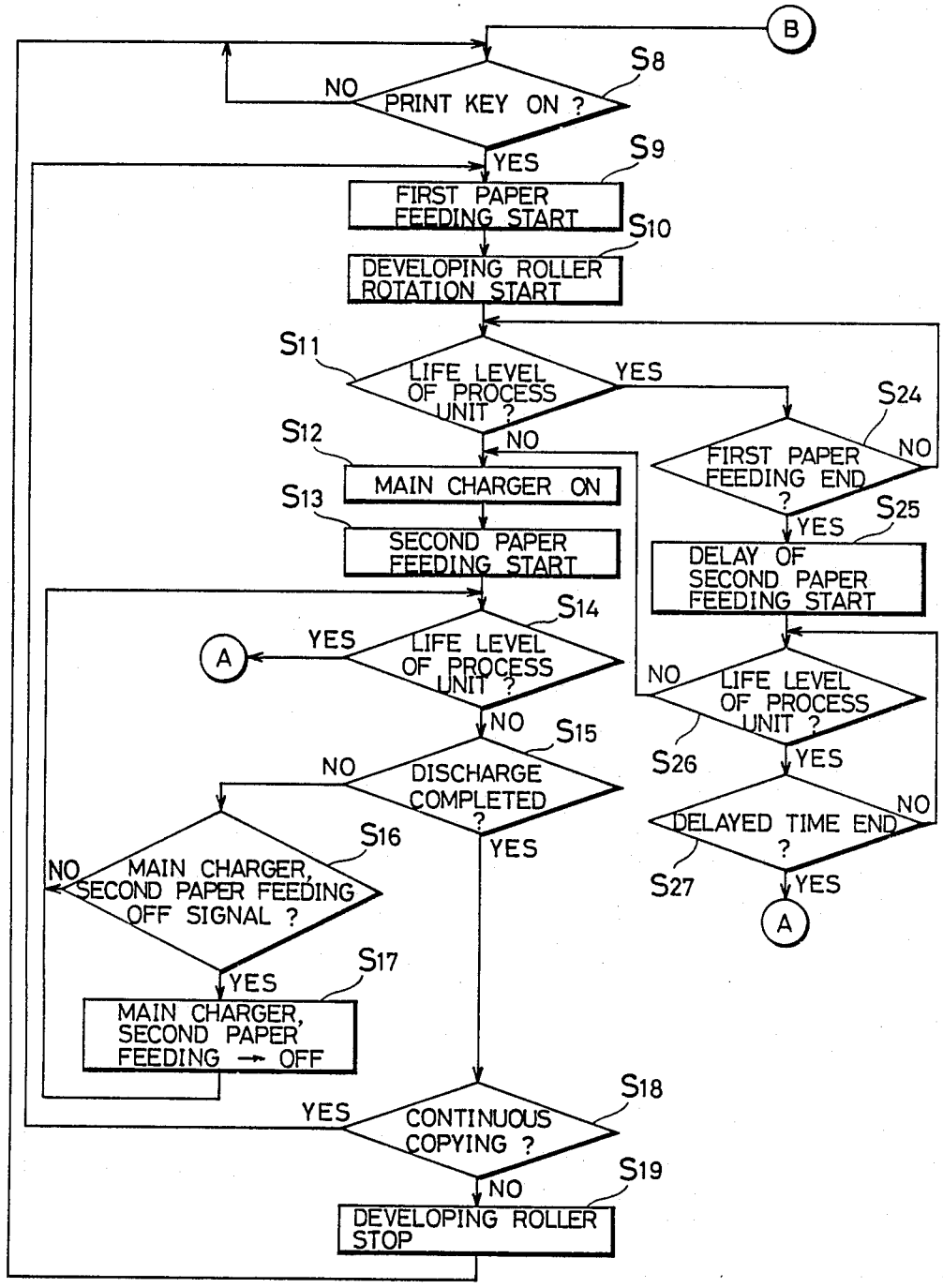
Figure 7:
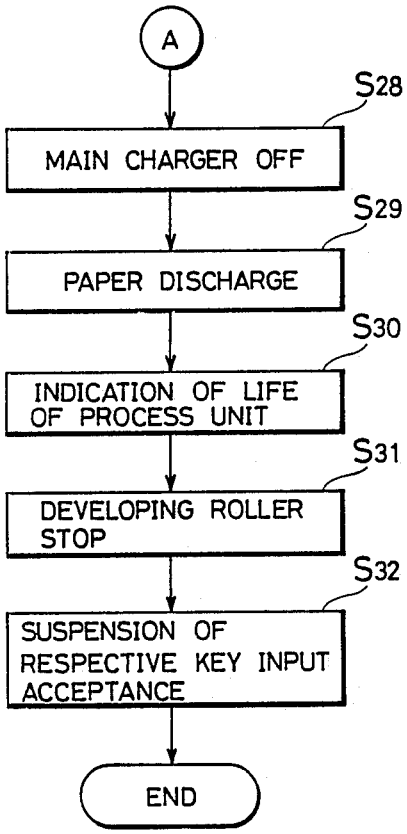

FIGS. 6A, 6B, and 7 are flow charts showing the operation of the control means 25, and the operation will be now described below in accordance with the flow charts.

Firstly the power source is switched on. The fixing heater 17*a* is then turned on (Step $S_1$) and the developing roller 14 starts rotating (Step $S_2$), and a delay time required for stabilizing the output of the sensor 65 is held by a timer (Step $S_3$). After lapse of the delayed time, it is judged based on a detecting signal from the sensor 65 whether the process unit 3 loses its life (Step $S_4$). When the process unit does not lose its life, the judgement is continued till the temperature of the fixing unit is stabilized (Step $S_5$). The judgement on whether the process unit loses its life is executed based on whether the output voltage of the sensor 65 is above a predetermined value. This judgement depends upon the fact that when toner contained in the process unit is consumed, the toner density of the developer (T/D) lowers and the output voltage of the sensor 65 rises.

When it is judged that the process unit 3 loses its life at Step $S_4$, copying is prohibited (Step $S_{20}$), the rotation of the developing roller 14 being stopped (Step $S_{21}$), the end of life of the process unit 3 being indicated on the life indicator 102 (Step $S_{22}$), input acceptance of the respective key being suspended (Step $S_{23}$). Subsequently, the operation is completed.

When the process unit 3 still has life, after the abovementioned Step $S_5$, the fixing heater 17*a* is turned off (Step $S_6$), the rotation of the developing roller 14 being stopped (Step $S_7$). This state is held until the print key 101 is turned on (Step $S_8$).

When the print key 101 is turned on, by turning on the paper feed clutch 19*a* to drive the paper feed roller 19, the first paper feeding is started (Step $S_9$). Then the developing roller 14 starts rotating (Step $S_{10}$), and thereafter it is judged based on a detecting signal from the sensor 65 whether the process unit 3 loses its life (Step $S_{11}$).

The abovementioned judgement is continued until the first paper feeding is completed (Step $S_{24}$), and before that, when the output voltage of the sensor 65 lowers below the predetermined value, it is judged that the process unit 3 does not reach its life and usual copying operation is started (Steps $S_{12}$ to $S_{19}$).

When the output voltage of the sensor 65 is still above the predetermined value at the end of the first paper feeding, the second paper feeding for feeding transfer paper from the pair of registration rollers 20 to the transferring position is not immediately started but the start thereof is delayed for a few seconds (Step $S_{25}$). This delay is made with the use of the timer 25*a* in the control means. In the delay time, it is judged again whether the process unit 3 loses its life (Steps $S_{26}$, $S_{27}$).

When the output voltage of the sensor 65 is below the predetermined value, the ordinary copying operation (Steps $S_{12}$ to $S_{19}$) is started in the similar manner as abovementioned. That is, the main charger 5 is turned on (Step $S_{12}$), and the pair of registration rollers 20 are driven to start the second paper feeding (Step $S_{13}$). Further, after the usual copying operation is started, the life of the process unit is successively detected depending upon the output voltage of the sensor 65 (Step 14). It is examined whether the transfer paper is completely discharged by turning on the discharge switch 22*a* (Step $S_{15}$).

When it is judged that the process unit 3 loses its life, the steps mentioned below with reference to FIG. 7 are carried out. On the other hand, while the process unit 3 still has life and the discharge of transfer paper is not completed, issue of OFF signals of the main charger 5 and the second paper feeding are observed (Step $S_{16}$). When the signals are issued, the main charger 5 and the pair of registration rollers 20 for the second paper feeding are turned off (Step $S_{17}$) and then the operation is returned to the abovementioned Step $S_{14}$.

When the discharge of transfer paper is completed at Step $S_{15}$, it is judged whether the copying is continuous one or not (Step $S_{18}$). If continuous copying, the operation is returned to Step $S_9$. If not, the rotation of the developing roller 14 is stopped (Step $S_{19}$), and the operation is returned to Step $S_8$, and thereafter the same routine is repeated.

On the other hand, when the output voltage of the sensor 65 is above the predetermined value at the end of the delayed time Step $S_{27}$, it is judged that the process unit loses its life, and then the operation is changed to the steps shown in FIG. 7. In other words, the main charger 5 is not driven but remains in an OFF state in order to prevent so-called carrier attraction (Step $S_{28}$). Paper is discharged (Step $S_{29}$). The end of life of the process unit 3 is indicated on the life indicator 102 (Step $S_{30}$). The driving of the developing roller 14 is stopped (Step $S_{31}$). Input acceptance of the respective key is suspended (Step $S_{32}$).

Execution of Steps $S_{28}$ to $S_{32}$ prevent the carrier attraction, resulting in no damage to the fixing device 17, further preventing jam of the transfer sheet in the conveying means. Also, the user can be informed that the process unit 3 has to be renewed.

Figure 8:
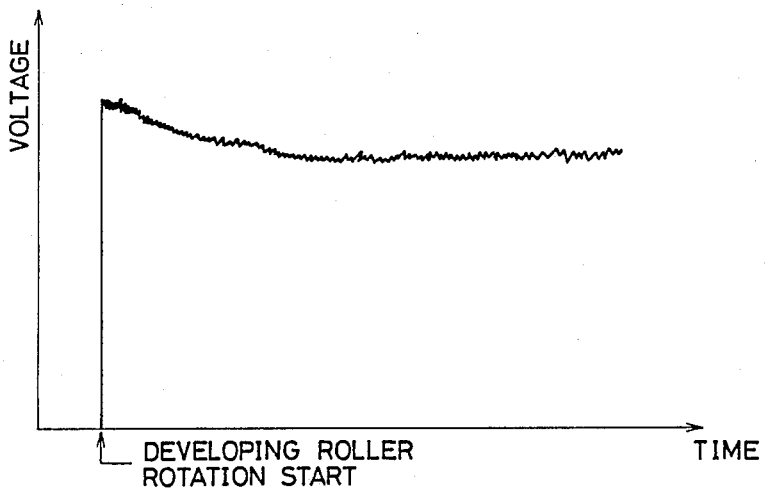
FIG. 8 is a graph showing an output characteristic of a toner density sensor.

Further, an output curve of the sensor 65 is shown as a characteristic of toner density in FIG. 8. The graph indicates that during the lapse of time from the start of the rotation of the developing roller 14, the output voltage lowers and comes to a stabilized state. Consequently, as abovementioned, by delaying the timing of the detection at Steps $S_3$ to $S_5$ or by delaying the start of the second paper feeding at Steps $S_{25}$ to $S_{27}$, and by detecting the output voltage of the sensor 65 in this delay time, the life level of the process unit 3 can be judged with the output voltage of the sensor 65 being stabilized, whereby the accuracy and reliability of the judgement is improved. Further, for accurately detecting the toner density by means of the sensor 65, the detection is carried out necessarily with the developing roller 14 being rotated. This requirement is also satisfied.

Furthermore, the life level of the process unit 3 is detected after switching on the power source and before turning on the print key as mentioned above. Consequently, when it is judged that the process unit 3 loses its life at this stage, the operation is changed to the state of prohibiting copying. Consequently, the first paper feeding which is to be started by turning on the print key and the succeeding operation are avoided. Accordingly, loses of transfer paper can be prevented.

Furthermore, since the output voltage of the sensor 65 is detected during the first paper feeding at Steps $S_{11}$ and $S_{24}$, no waiting time is needed for the detection. Accordingly, the copying efficiency can be improved. Also, the life of the process unit 3 is detected at Step $S_{14}$ after the operation is changed to the second paper feeding and during the usual copying operation. Consequently, if the process unit 3 loses its life during the copying operation, any occurrence of the abovementioned carrier attraction can be prevented because of the turning-off of the main charger.

In the abovementioned embodiment, the life of the process unit 3 can be detected at the following three times; during the delayed time of the first and second feeding, after the turning-on of the print key; after switching on the power source and before turning on the print key; in the usual copying operation after the second paper feeding. It will be noted, however, that the detection need not necessarily be made at all these times. It is required only that the detection is executed in one of the following two times: the time after the start of the rotation of the developing roller 14 and before the end of the first paper feeding, and the time that the start of the second paper feeding is delayed. Accurate life detection can be similarly achieved even at each time.

In the abovementioned explanation of the flow chart, as the time of detecting life is mentioned the time required to stabilize the fixing device 17 and the time required to complete the first paper feeding. Such time may be obtained from detecting the signal level of the thermistor **17*d* or the signal from the registration switch 20*a***. Also, such time may be obtained from a delayed time of the timer on the basis of the times of turning on the print key, starting the first paper feeding, and starting the rotation of the developing roller and the like.

Further, process unit 3 of the abovementioned embodiment carries a photosensitive drum 4, the developing device 6, the cleaning device 7 and the like, all the components being placed in one casing. However, it is satisfactory that only the developing device 6 is provided.

Furthermore, when it is detected that the process unit still has life before the predetermined time lapses, the operation is immediately changed to the usual copying operation. Consequently, unnecessary waiting time is not wasted and the efficiency of the image forming operation can be improved.

Figure 9:
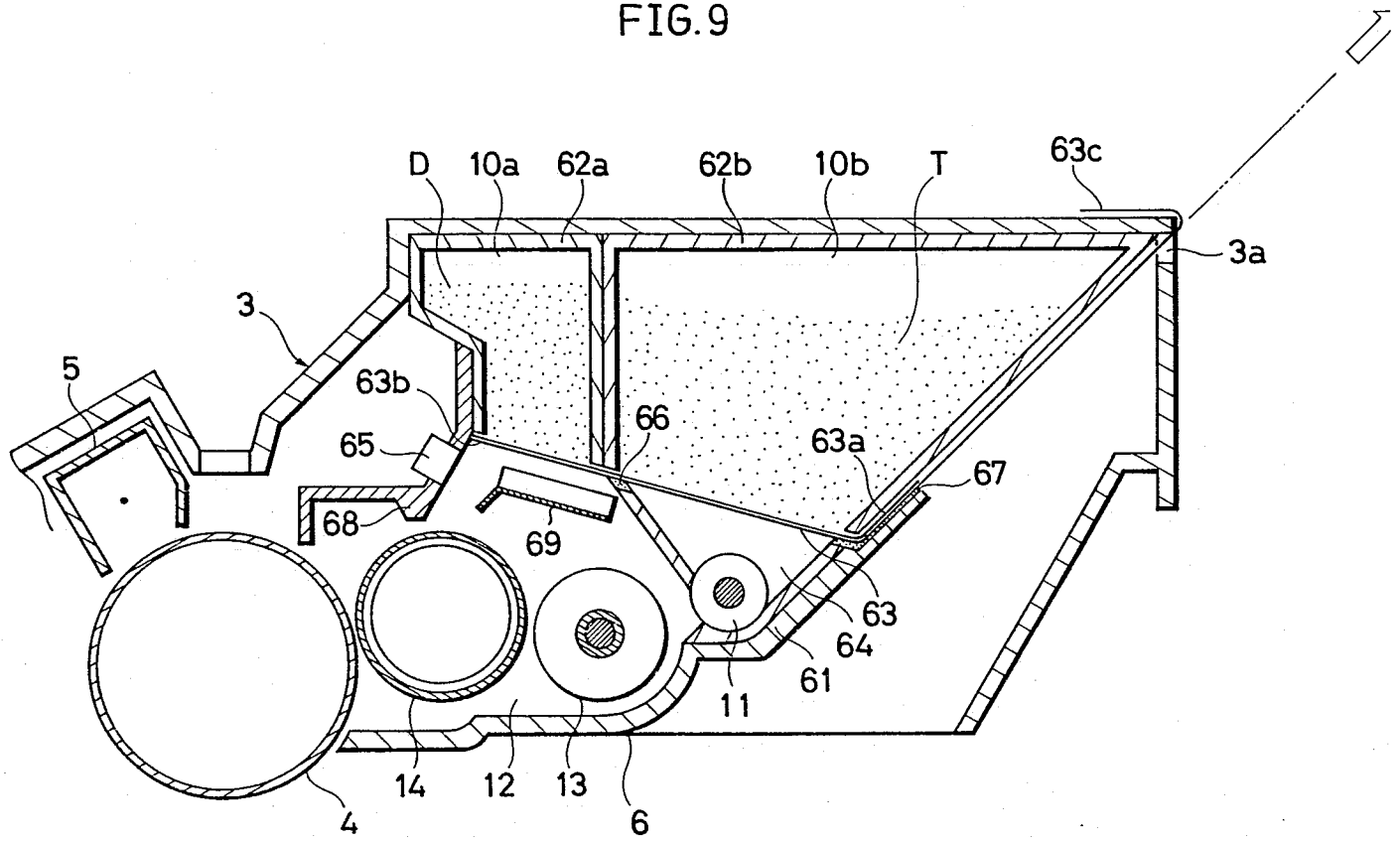
FIG. 9 is a partly sectional view of the process unit.

FIG. 9 mainly illustrates developing device 6 of process unit 3.

The upper part of casing 61 of developing device 6 is attached with containers **62*a*, 62*b* constituting the developer storage sections 10*a*, 10*b*. Downward openings of containers 62*a*, 62*b* are sealed by means of a seal member 63 before use. That is, one end portion 63*a* of the seal member 63 is stuck to one edge of one container 62*b*, and an intermeditate portion 63*b* is stuck to one edge of the other container 62*a* and is then folded back so that the other end portion 63*c* is passed through a slit 3*a* provided in the process unit 3** to the outside.

Before attaching the process unit 3 to the apparatus 1, the other end portion **63*c* of the seal member 63 is pealed off in the direction of the arrow in FIG. 9. Subsequently, the seal is opened and initial developer D in the developer storage section 10*a* is supplied into the developer chamber 12 while toner T is supplied from the developer storage section 10*b* into a hopper 64 provided with the supply roller 11**.

Further, adjacent to the developing device 6 is provided the sensor 65 including a magnetic permeability sensor for detecting the toner density of the developer contained in the developing device 6. The control means 25 controls the rotation of the supply roller 11 according to the output of the sensor 65 so that the density of the toner contained in the developing device 6 comes to a predetermined value.

Figure 10:
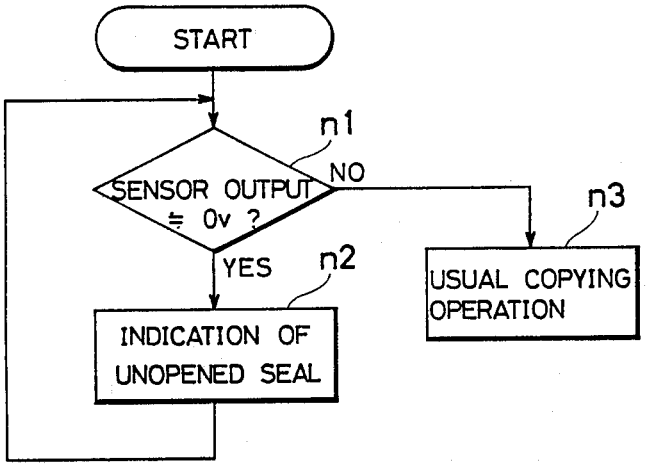
FIG. 10 is a flow chart showing the operation for detecting opening of a seal member.

In FIG. 9, numerals 66, 67 indicate packings made of sponge or the like for preventing the developer from being dispersed after the seal is opened. Numeral 68 indicates the header for regulating the height of the developer on the developing roller 14. Numeral 69 indicates a guide plate for helping circulation of the developer. In the abovementioned construction, the sensor 65 detects the toner density of the developer passing in front of the sensor 65. Specifically, the ratio of the toner amount to the total amount of toner and carrier (T/D) is detected in the case of a two component developer. In the usual use state (e.g. T/D being 4.5% to 2%, because the carrier is added, the sensor 65 outputs a level of voltage (e.g. 1 V to 4 V). On the other hand, when no carrier is added, it outputs an extremely low voltage of nearly 0 V. In the usual use state, the sensor does not output such a low voltage. When such a low output voltage is sent to the control means 25, it is judged that no developer is supplied into the developing device 6 i.e., into the developer chamber 12 indicating that the seal member 63 is unopened. The judging operation of the control means 25 will be described below with reference to the flow chart in FIG. 10.

Firstly, the power source is switched on. Then, it is judged whether the output voltage of the sensor 65 is nearly 0 V (Step $n_1$). When the answer is YES, it is judged that the seal is unopened, which is indicated at Step $n_2$. This can be realized by making a suitable indication on the operation and indication portion 26 so as to call it to the user's attention. On the other hand, when the answer is NO, it is judged that the apparatus is in the usual state and the operation is changed to the usual copying operation. The judgement that developer is consumed and not left in the developer chamber (i.e. it is that time to renew the process unit 3) can be made by detecting that the output voltage of the sensor 65 reaches a predetermined value (e.g. 4 V) for preventing the degradation of the image quality.

Further, the abovementioned judgement on whether the seal is opened is preferably made before the first paper feeding is started by turning on the print key.

According to the abovementioned embodiment, detection that the seal is unopened is executed by the toner control sensor 65 which is a conventional sensor. In other words, it is not required to make a particular sensor for executing this operation. Consequently a reduced cost is obtained.

Further, in the abovementioned embodiment, a two component developer is used and a sensor signal from the toner control sensor 65 is used. However, the present invention is not limited to the abovementioned embodiment. For example, when a one component developer is used, a level sensor or a pressure sensor is used which can detect the presence of developer in the developer chamber 12 and can provide an output in the form of analog signals. Subsequently, unopening of the seal can be detected according to the sensor signals. When the seal is unopened, the output of sensors is 0 V or nearly 0 V. On the other hand, the output of the sensor for judging that developer is consumed and not left in the developer chamber is set at a higher value than that of the judgement of unopening of the seal. Accordingly, the difference between the output voltages makes it possible to distinguish unopening of the seal from consumption of the developer.

Further, the output voltage of the sensor is changed when the seal member 63 is peeled off by sticking a magnetic piece to a portion of the seal member 63 and placing the seal member in such a manner that the magnetic piece is positioned in front of the toner control sensor 65, though not illustrated. This is because the magnetic piece in front of the sensor 65 is removed. Accordingly, opening of the seal can be also detected in this way.

Figure 11:
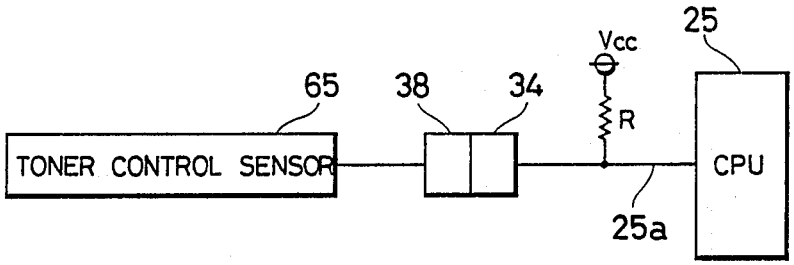
FIGS. 11 and 12 are block diagrams showing construction of the device for detecting attachment of the process unit to the apparatus.
Figure 12:
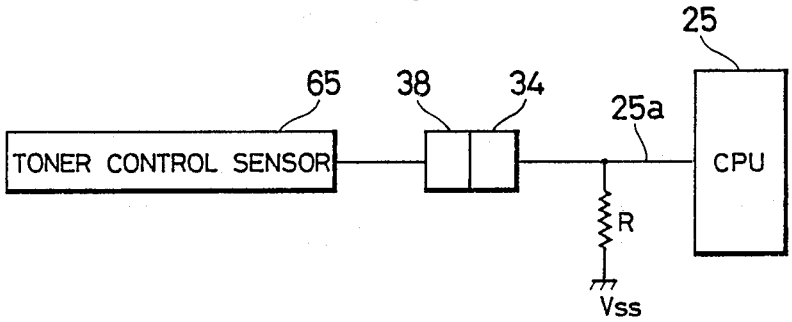

FIGS. 11, 12 illustrate a construction of the present invention for detecting attachment of the process unit 3 to the image forming apparatus 1. An input terminal 25*a* of the control means 25 is connected to a resistance R (preferably having a high impedance) which is connected to a predetermined Vcc (e.g. 5 V) potential or to Vss (earth=0 V). In the abovementioned construction, when the process unit 3 is not attached to the apparatus, the voltage level of the input terminal 25*a* of the control means 25 is Vcc or Vss.

On the other hand, when the process unit 3 is attached to the apparatus 1, the output terminal of the sensor 65 is connected to the input terminal 25*a* of the control means 25 by the connectors 38, 34. Then, the sensor 65 located adjacent to the developing device 6 detects the toner density of the developer passing in front of the sensor 65, that is, the ratio of the toner amount to the total whole amount of carrier and toner (T/D) when a two component developer is used. In the usual use state (e.g. T/D being 4.5% to 2%), the sensor 65 outputs a level of voltage (e.g., 1 V to 4 V) due to the presence of the carrier. Consequently, the voltage level of the input terminal 25*a* of the control means 25 is the same as the output level of the sensor 65, though somewhat influenced by a bias potential due to the presence of the resistance R. It will be noted that when using the resistance R having a high impedance, such an influence is almost removed. In other words, there is a difference between the potential level of the input terminal 25*a* of the control means 25 when the process unit 3 is attached to the apparatus and the potential level when it is not attached thereto. Consequently, when the voltage of the input terminal 25*a* of the control means 25 (0 V to 4 V or 4 V to 5 V) is different from the voltage level of the use state (e.g. 1 V to 4 V), the control means 25 can judge that the process unit 3 is not attached to the apparatus 1.

Figure 13:
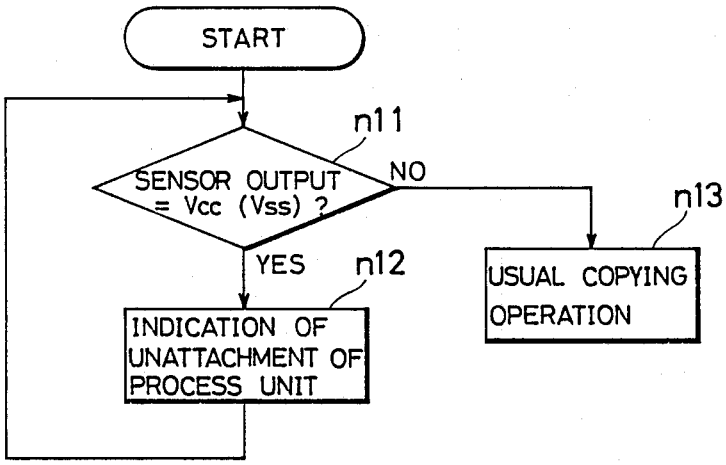
FIG. 13 is a flow chart showing the operation for detecting attachment of the process unit to the apparatus.

This judging operation of the control means 25 will be described below with reference to the flow chart in FIG. 13.

Firstly, the power source is switched on. Then, it is judged whether the output voltage of the sensor 65 is Vcc (or Vss) or not (Step $N_{11}$). When the answer is YES, the process unit 3 is judged to be unattached, which is indicated at Step $n_{12}$. This can be realized by making a suitable indication on the operation and indication portion 26 so as to call the user's attention. For the purpose of more surely calling the user's attention, besides making such an indication, the image forming operation may be stopped. On the other hand, when the answer is NO, it is judged that the process unit is attached to the apparatus 3 and the operation is changed to the usual copying operation (Step $n_{13}$). The judgement that the developer in the developer chamber is consumed (i.e. That it is the time to renew the process unit 3) can be made by detecting that the output voltage of the sensor 65 reaches a predetermined level (e.g. 4 V for preventing the degradation of the image quality).

As abovementioned, for detecting the attachment of the process unit 3, a particular switch for executing this operation is not required. Consequently, a reduced cost can be obtained.

It will be apparent that the potential Vcc or Vss, to which the input terminal 25*a* of the control means 25 is connected by the resistance R, is needed to be set at a value different from the output level of the sensor 65 of the usual use state. Further, when the control means 25 includes a microcomputer, the input terminal is usually provided with an A/D converting circuit. Subsequently, an unstabilized voltage, though of a slight amount, caused due to a remaining charge of a capacitor of this circuit has an influence when no circuit is connected to the input terminal 25*a*. However, connection of the input terminal 25*a* to a potential of a predetermined voltage level by the resistance R eliminates the abovementioned influence. Consequently, unattachment of the process unit 3 can be accurately detected.

Further, unattachment of the process unit 3 can be detected by using a level sensor, a pressure sensor or the like as abovementioned as well as the toner control sensor 65. The potential of the input terminal 25*a* is Vcc or Vss when the process unit is unattached. On the other hand, the output level used for judging that the developer in the developer chamber is consumed up is set at a predetermined value different from Vcc or Vss. Consequently, such a difference between the two potentials of the input terminal 25*a* makes it possible to distinguish unattachment of the process unit 3 from consumption of the developer.

What is claimed is:

1. A device for detecting the life of a process unit having a toner and which is detachably mounted in an image forming apparatus comprising:

sensor means for detecting the density of the toner in said process unit;

signal detecting means receiving an output from said sensor means and operable to stabilize said output and to determine whether said stabilized output exceeds or is less than a predetermined value; and control means connected to said signal detecting means and operable to effect different operating conditions depending on whether said stabilized output exceeds or is below said predetermined value, one of said operating conditions being an indication that the life of said process unit has expired and another of said operating conditions being an indication that the life of said process unit is unexpired.

2. A device for detecting the life of a process unit which is detachably mounted in an image forming apparatus, the process unit being of the type having a developing device including a developing roller in a casing, the combination comprising:

sensor means for detecting the density of the toner in said developing device;

signal detecting means receiving an output from said sensor means and operable to determine whether said output exceeds or is less than a predetermined value during a predetermined time period which starts after said developing roller starts rotating; and control means connected to said signal detecting means and operable to effect different operating conditions depending on whether said output exceeds or is below said predetermined value, one of said operating conditions being an indication that the life of said process unit has expired and another of said operating conditions being an indication that the life of said process unit is unexpired.

3. A device according to claim 2, wherein said signal detecting means comprises a timer for timing said predetermined time period, said predetermined time period providing for stabilizing the output of said sensor means.

4. A device according to claim 2, wherein said control means is operable to provide for continued operation of the image forming apparatus when said output is below said predetermined value and to preclude operation of the image forming apparatus when said output exceeds said predetermined value.

5. A device according to claim 4, wherein said image forming apparatus has a power switch and a print switch with said power switch enabling said print switch to provide for selectively initiating a copying operation of said apparatus, said signal detecting means being operable to receive said output and to make said determination after activation of said power switch and prior to activation of said print switch such that the life of the process unit is detected prior to initiating a copying operation with said print switch.

6. A device according to claim 5, wherein said image forming apparatus has paper feeding means, said control means being operable to disable said paper feeding means when said signal detecting means has determined that said output from said sensor means exceeds said predetermined value to preclude feeding of paper when said print switch is activated.

7. A device according to claim 2, wherein said image forming apparatus has a print switch to initiate operation of a copying operation which includes feeding sheets of paper to be copied, said sensor means output which is detected during said predetermined time period being designated a first output, said signal detecting means detecting a second output from said sensor means during the time that said paper feeding means feeds said first sheet of paper and being operable to determine whether said second output exceeds or is below said predetermined value.

8. A device according to claim 7, wherein when said signal detecting means determines that said second output is below said predetermined value, said control means is operable to commence a continuous copying operation which includes activation of a main charger and activation of paper feeding means to initiate feeding of subsequent sheets of paper, said signal detecting means being operable to detect a further output from said sensor means after commencement of said continuous copying operation and to determine whether said further output exceeds or is below said predetermined value during said continuous copying operation.

9. A device according to claim 7, wherein when said signal detecting means determines that said second output exceeds said predetermined value, said control means is operable to provide a delayed time period between the time of completion of feeding of said first sheet of paper and starting of feeding of a second sheet of paper, said signal detecting means being operable to detect a third output from said sensor means during said delayed time period and to determine whether said third output exceeds or is below said predetermined value.

10. A device according to claim 9, wherein said signal detecting means comprises a timer for timing said delayed time period.

11. A device according to claim 2, wherein said image forming apparatus has a print switch operable to start rotation of said developing roller to initiate a copying operation and a paper feeding means to feed a first sheet of paper upon activation of said print switch, said control means being operable to provide a delay period to delay the start of feeding of a second sheet of paper, said delay period corresponding to said predetermined time period.

12. A device according to claim 11, wherein said control means comprises a timer for determining said delay period.

13. A device according to claim 11, wherein said delay period commences upon completion of feeding of said first sheet of paper and continues until the start of feeding of said second sheet of paper.

14. A device according to claim 13, wherein said signal detecting means is operably to provide a judgement determination of whether said sensor signal output exceeds or is below said predetermined value while said first sheet of paper is being fed, said control means being operable to provide said delay period when said judgement determination exceeds said predetermined value, said control means being operable to commence feeding said second sheet of paper after completion of feeding of said first sheet and without such delay period when said judgement determination is below said predetermined value.

15. A device according to claim 2, wherein said process unit has a container with a removeable seal member, said detecting means being operable to receive an output from said sensor means and to provide a seal condition output indicative of whether said process unit has been placed in said image forming apparatus with or without the seal having been removed from the process unit.

16. A device according to claim 15, wherein said image forming apparatus has a power switch and a print switch with said power switch enabling said print switch to provide for selectively initiating a copying operation of said image forming apparatus, said signal detecting means being operable to provide said seal condition output signal after said print switch has been enabled by said power switch and prior to activation of said print switch to initiate a copying operation.

17. A device according to claim 2, wherein said image forming apparatus and said process unit have cooperable attachment means to effect an operable attachment between said image forming apparatus and said process unit, said signal detecting means being operable to receive an output from said sensor means and to provide an attachment condition output indicative of whether or not said process unit has been attached to said image forming apparatus by said cooperable attachment means.

18. A device for detecting the life of a process unit which is detachably mounted in an image forming apparatus, the process unit being of the type having a developing device and a container with a removeable seal member, the combination comprising:

sensor means providing an output for detecting the density of the toner in said developing device and for detecting the condition of said seal;

signal detecting means receiving said output from said sensor means and operable to determine whether said output exceeds or is less than a predetermined value;

control means connected to said signal detecting means and operable to effect different operating conditions depending on whether said output exceeds or is below said predetermined value, one of said operating conditions being an indication that the life of said process unit has expired and another of said operating conditions being an indication that the life of said process unit is unexpired; and operable means receiving said output from said sensor means and operable to provide a seal condition output indicative of whether said process unit has been placed in said image forming apparatus with or without the seal having been removed from the process unit.

19. A device for detecting the life of a process unit which is detachably mounted in an image forming apparatus, the process unit being of the type having a developing device and a container with a seal member which can be opened, the combination comprising:

sensor means providing an output for detecting the density of the toner in said developing device;

signal detecting means receiving said output from said sensor means and operable to determine whether said output exceeds or is less than a predetermined value; and operable means receiving said output from said sensor means and operable to provide a seal condition output indicative of whether said process unit has been placed in said image forming apparatus with or without the seal having been opened.

20. A device for detecting the life of a process unit which is detachably mounted in an image forming apparatus, the process unit being of the type having a developing device and a cooperable attachment means to effect a cooperable attachment between the image forming apparatus and the process unit, the combination comprising:

sensor means providing an output for detecting the density of the toner in said developing device and for detecting the condition of said attachment means;

signal detecting means receiving said output from said sensor means and operable to determine whether said output exceeds or is less than a predetermined value;

control means connected to said signal detecting means and operable to effect different operating conditions depending on whether said output exceeds or is below said predetermined value, one of said operating conditions being an indication that the life of said process unit has expired and another of said operating conditions being an indication that the life of said process unit is unexpired; and operable means receiving said output from said sensor means and operable to provide an attachment condition output indicative of whether or not said process unit has been attached to said image forming apparatus by said cooperable attachment means.

21. A device for detecting the life of a process unit which is detachably mounted in an image forming apparatus, the process unit being of the type having a developing device and a cooperable attachment means to effect a cooperable attachment between the image forming apparatus and the process unit, the combination comprising:

sensor means providing an output for detecting the density of the toner in said developing device;

signal detecting means receiving said output from said sensor means and operable to determine whether said output exceeds or is less than a predetermined value; and operable means receiving said output from said sensor means and operable to provide an attachment condition output indicative of whether or not said process unit has been attached to said image forming apparatus by said cooperable attachment means.

* * * * *